US010820112B2

(12) United States Patent
Li

(10) Patent No.: US 10,820,112 B2
(45) Date of Patent: Oct. 27, 2020

(54) SPEAKER

(71) Applicant: AAC Technologies Pte. Ltd., Singapore (SG)

(72) Inventor: Denglin Li, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,206

(22) Filed: Jul. 29, 2019

(65) Prior Publication Data

US 2020/0045462 A1 Feb. 6, 2020

(30) Foreign Application Priority Data

Aug. 1, 2018 (CN) ..... 2018 2 1236267 U

(51) Int. Cl.

| | |
|---|---|
| ***H04R 9/06*** | (2006.01) |
| ***H04R 9/02*** | (2006.01) |
| ***H04R 7/12*** | (2006.01) |
| ***H04R 7/16*** | (2006.01) |

(52) U.S. Cl.

CPC ..... *H04R 9/06* (2013.01); *H04R 7/12* (2013.01); *H04R 7/16* (2013.01); *H04R 9/025* (2013.01); *H04R 2400/11* (2013.01)

(58) Field of Classification Search

CPC ..... H04R 9/025; H04R 9/027

USPC ..... 381/420–421

See application file for complete search history.

(56) References Cited

U.S. PATENT DOCUMENTS

| | | | | |
|---|---|---|---|---|
| 8,660,292 | B2 * | 2/2014 | Li | H02K 33/16 381/412 |
| 2015/0365768 | A1 * | 12/2015 | Andersen | H04R 9/046 381/421 |
| 2018/0027332 | A1 * | 1/2018 | Mao | H04R 7/127 381/421 |

* cited by examiner

*Primary Examiner* — Suhan Ni
(74) *Attorney, Agent, or Firm* — W&G Law Group LLP

(57) ABSTRACT

The speaker of the present invention comprises a frame, a vibration system and a magnetic circuit system. The vibration system comprises a diaphragm and a voice coil assembly for driving the vibration of the diaphragm for generating sound, the diaphragm is located on the frame, and the voice coil assembly is connected with the diaphragm and the magnetic circuit system includes a first clamping plate, a yoke, and a main magnetic and a sub magnetic disposed in the yoke. Wherein the bonding portion of the first clamping plate and the sub magnetic is provided with an adhesive groove recessed from the bonding portion away from the sub magnetic. When the first clamping plate is bonded to the sub magnetic, the glue is filled between the first clamping plate and the sub magnetic and filled in the adhesive groove.

9 Claims, 8 Drawing Sheets

SPEAKER

FIELD OF THE DISCLOSURE

The present disclosure relates to sound generator, and more particularly to a speaker applied in a portable electronic device.

DESCRIPTION OF RELATED ART

In order to adapt to the development trend of miniaturization and multi-function of various audio equipment and information communication equipment, the sound generator used in various equipment should be more miniaturized and more compact with other components around the sound generator.

Especially with the development of mobile phones, the sound generator used therein requires not only miniaturization, but also excellent anti-drop performance.

Therefore, the solidity of the connection between the components used in the speaker directly affects the failure rate of the speaker in the drop test.

In related art, a speaker comprises frame, vibration system and magnetic circuit system. The vibration system comprises diaphragm and voice coil assembly driving the diaphragm to vibrate for generating sound. The diaphragm is located above the frame. The voice coil assembly is coupled to the diaphragm and received in the frame. The magnetic circuit system comprises a first clamping plate disposed in the frame, a yoke, a main magnetic received in the yoke, and sub magnetic which is disposed on both sides of the main magnetic and is spaced apart from the main magnetic to form a magnetic gap in the yoke, and the voice coil assembly is inserted in the magnetic gap. Wherein the sub magnetic is usually adhered to the first clamping plate by glue, and the width of the first clamping plate narrower than the sub magnetic, the region of bonding with the sub magnetic is small, thus the bonding force between the first clamping plate and the sub magnetic is small, so in the drop experiment, it is easy to make the first clamping plate and the sub magnetic of the speaker are detached, thereby, resulting in failure of the speaker.

Therefore, it is desired to provide a speaker to overcome aforesaid problems.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Embodiment 1

Figure 1:
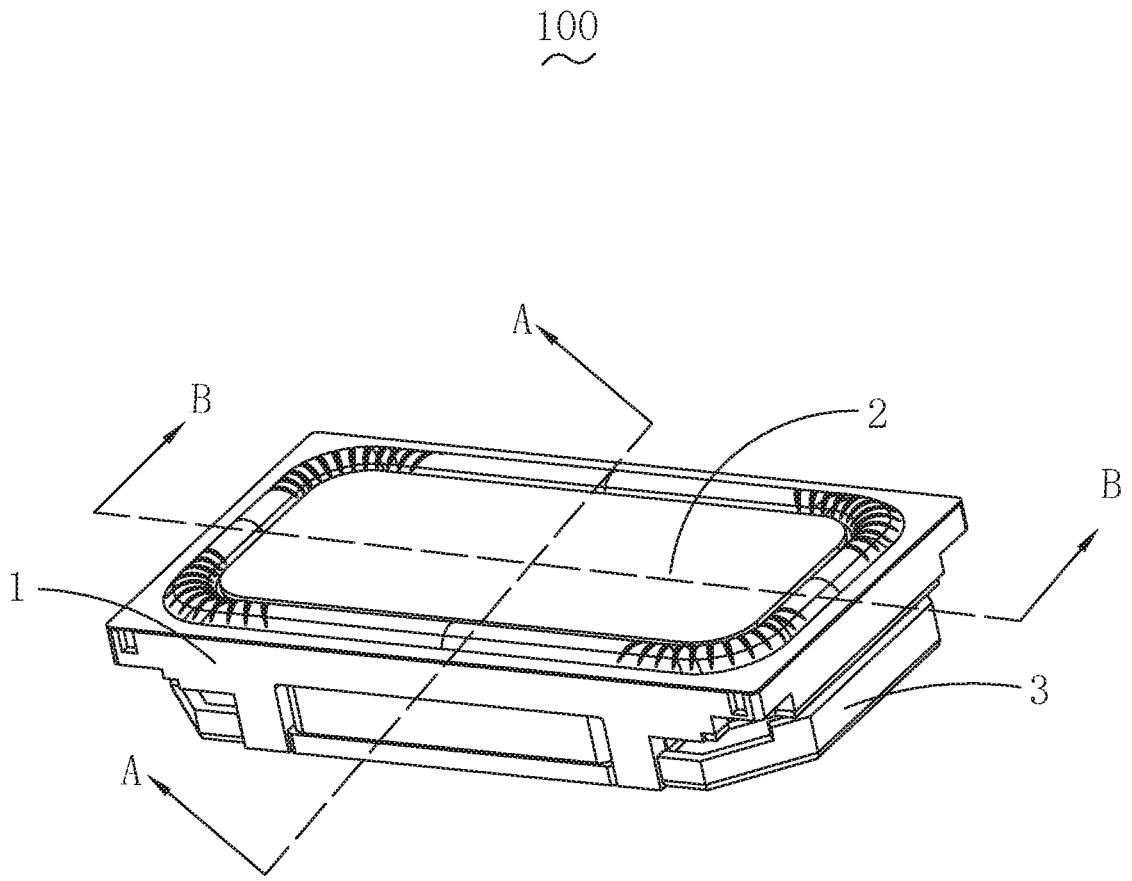
FIG. 1 is a three-dimensional diagram of structure of the speaker in accordance with an exemplary embodiment of the present disclosure.
Figure 2:
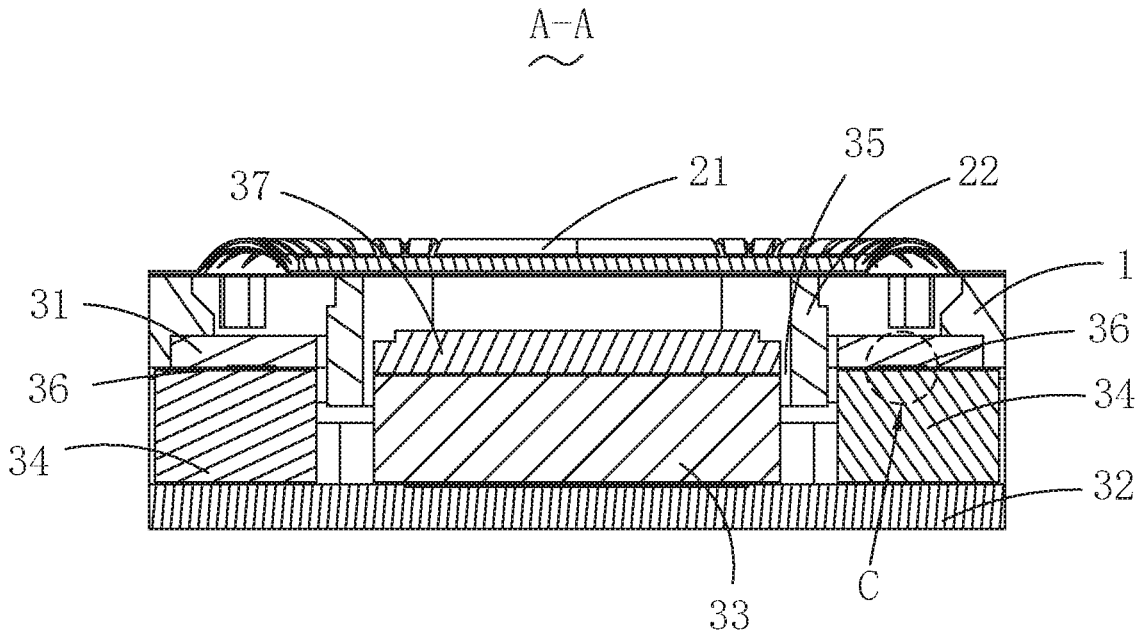
FIG. 2 is a cross-sectional diagram along the A-A line showing in FIG. 1.
Figure 3:
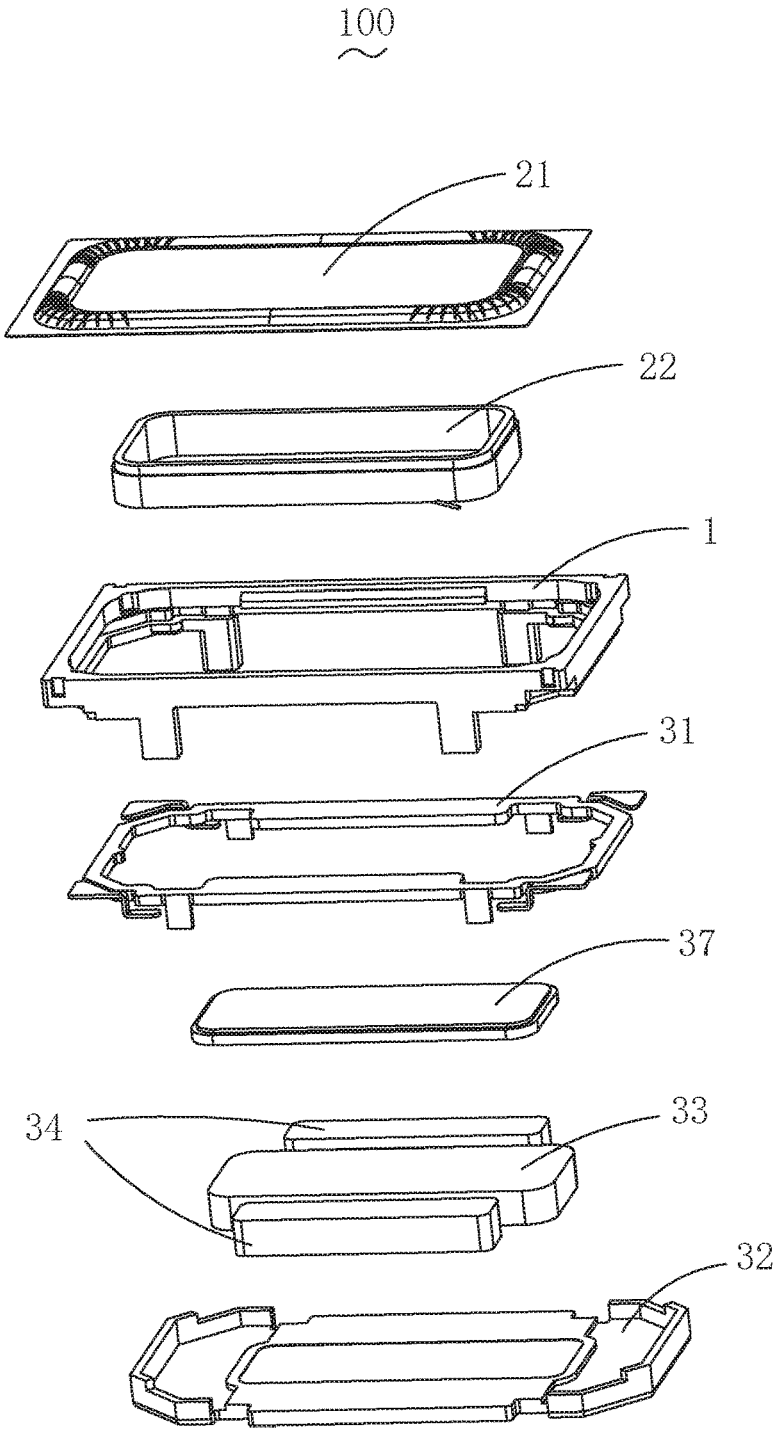
FIG. 3 is a three-dimensional perspective diagram of the structure of the speaker exploded view showing in FIG. 1.

Please also refer to FIG. 1-3, wherein FIG. 1 is a three-dimensional diagram of structure of the speaker in accordance with an exemplary embodiment of the present disclosure; FIG. 2 is a cross-sectional diagram along the A-A line showing in FIG. 1; and FIG. 3 is a three-dimensional perspective diagram of the structure of the speaker exploded view showing in FIG. 1. The present disclosure provides a speaker 100, which comprises a frame 1, a vibration system 2 and a magnetic circuit system 3.

The vibration system 2 comprises a diaphragm 21 and voice coil assembly 22 driving the diaphragm 2 to vibrate for generating sound. The diaphragm 21 is located above the frame 1. The voice coil assembly 22 is connected to the diaphragm 21 and housed inside the frame 1. The magnetic circuit system 3 comprises a first clamping plate 31 housed in the frame 1, a yoke 32, a main magnetic 33 and a sub magnetic 34 disposed in the yoke 32. The sub magnetic 34 is located on both sides of the main magnetic 33, and the sub magnetic 34 and the main magnetic 33 are spaced apart from each other to form a magnetic gap 35, the voice coil assembly 22 is inserted into the magnetic gap 35. The first clamping plate 31 is disposed on the sub magnetic 34 and connected to the sub magnetic 34, the first clamping plate 31 comprises a bonding portion 311 connected to the sub magnetic 34, and the bonding portion 311 is provided with an adhesive groove 312. The adhesive groove 312 is recessed in the direction from the plane connecting the bonding portion 311 and the sub magnetic 34 toward away from the sub magnetic 34, and the adhesive body 36 is filled in the gaps between the bonding portion 311 and the sub magnetic 34, the adhesive body 36 is glue.

The magnetic circuit system of the speaker in the present embodiment includes a first clamping plate, a yoke, a main magnetic and a sub magnetic received in the yoke. Wherein the adhesive groove is arranged at the bonding portion of the first clamping plate and the sub magnetic, and the plane connecting the self-bonding portion of the adhesive groove and the sub magnetic is depressed away from the sub magnetic. When the first clamping plate is bonded with the sub magnetic, the glue is filled between the first clamping plate and the sub magnetic and the adhesive groove is filled. The setting of the adhesive groove enlarges the contact area between the glue and the first clamping plate, and is convenient to increase the glue dosage without glue overflowing the glue surface, thus increasing the bonding force between the first clamping plate and the sub magnet, and improving the bonding force between the first clamping plate and the sub magnetic. The problem of separation failure due to the small bonding force between the first clamping plate and the sub magnetic in drop test is solved.

Embodiment 2

Figure 4:
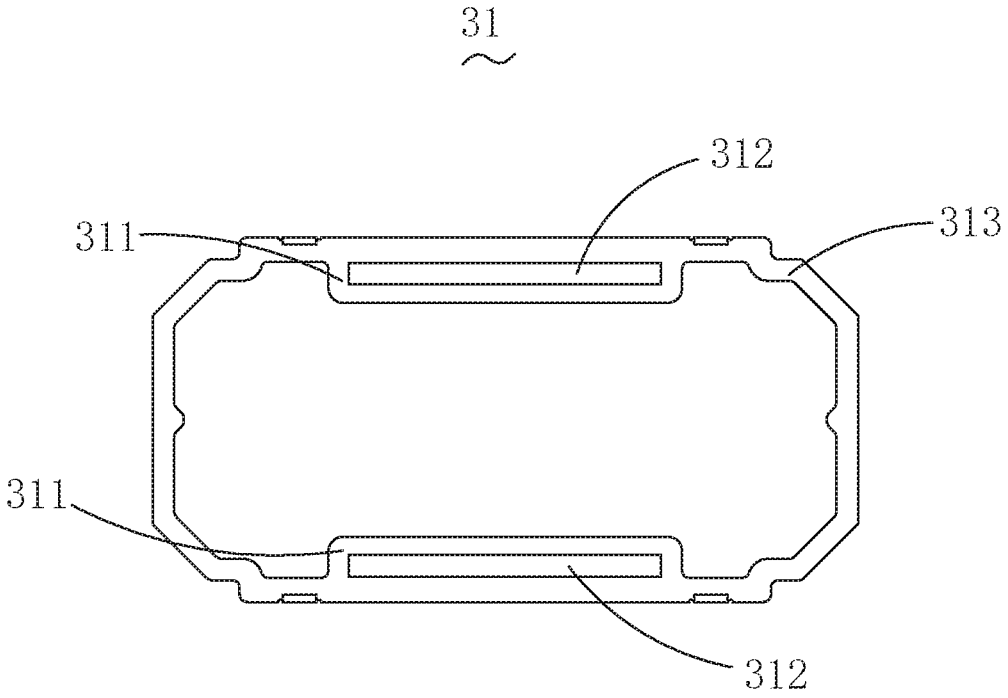
FIG. 4 is a plan view of the first clamping plate showing in the FIG. 1.

As shown in FIG. 4, FIG. 4 is a plan view of the first clamping plate showing in the FIG. 1. The other features of the speaker provided in the embodiment 2 are the same as those in the embodiment 1, the difference is that the first clamping plate 31 further includes a splint frame 313, which is fixed to the frame 1.

It should be noted that the shape of the splint frame 313 is preferably the same as that of the yoke 32 edges around the circumference, but the shape of the splint frame 313 is any shape that can support the bonding portion 311 on the frame 1. The bonding portion 311 extends from the splint frame 313 in the direction toward the main magnetic 33. In the plane where the yoke 32 is located, the projection of the bonding portion 311 is completely coincides with the projection of the sub magnetic 34.

It should be pointed out that, on the basis of meeting the demand of miniaturization of the speaker, the width of the bonding portion 311 is set as wide as possible, and its width can be the same as that of the sub magnetic 34. However, the width of the bonding portion 311 is slightly narrower than that of the sub magnetic 34, which is accommodated in the frame 1. The first clamping plate 31 has a centro-symmetric structure.

The first clamping plate also includes a splint frame, which is used to support the bonding portion to make the clamping plate structure more stable. The adhesive groove is arranged in the bonding portion. When the first clamping plate is bonded with the sub magnetic, the glue is filled between the first clamping plate and the sub magnetic and the glue groove is filled. The setting of the glue groove enlarges the contact area between the glue and the upper magnetic conductivity splint and facilitates the increase of the glue dosage without glue overflowing the glue surface, thereby increasing the bonding force between the first clamping plate and the sub magnetic, and improving the problem that the first clamping plate and the sub magnetic have a small bonding force and the separation failure in the drop test.

Embodiment 3

Figure 5:
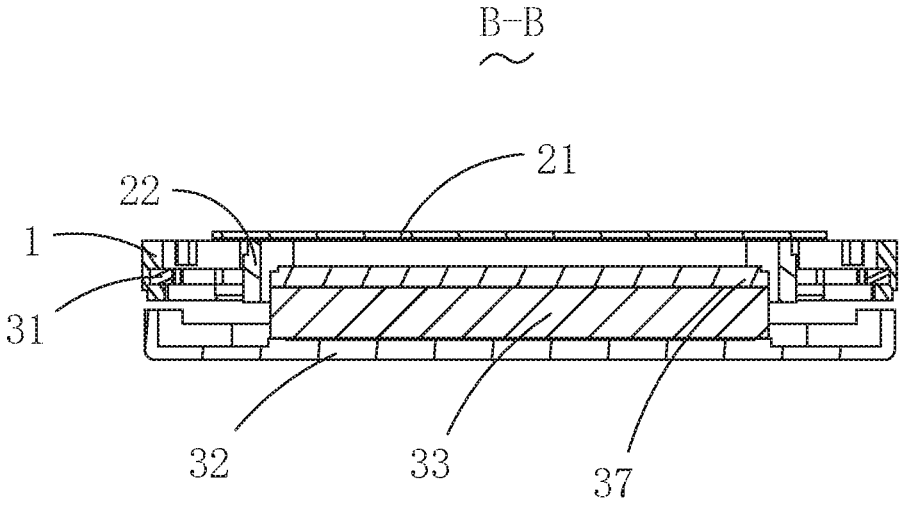
FIG. 5 is a cross-sectional diagram along the B-B line showing in FIG. 1.
Figure 6:
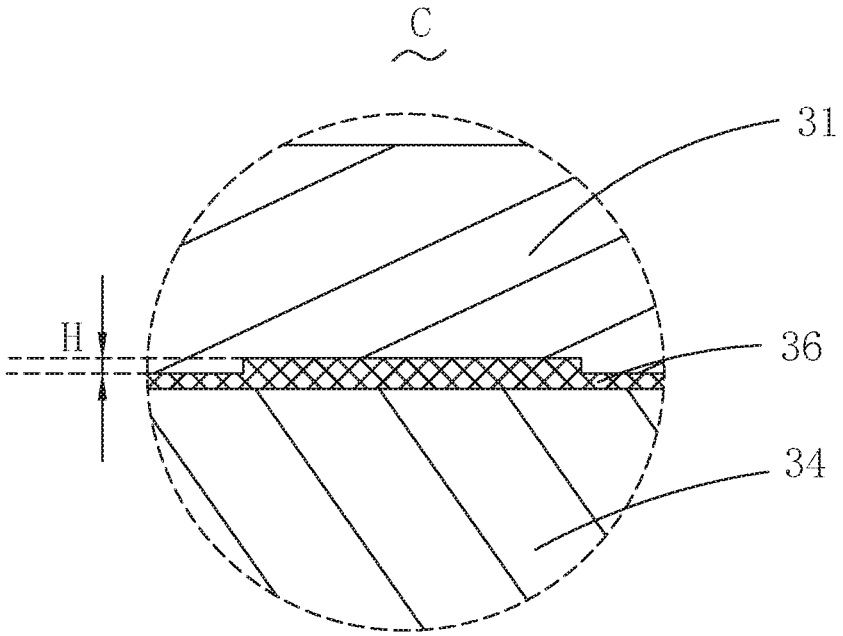
FIG. 6 is an enlarged view of a portion C of FIG. 2.
Figure 7:
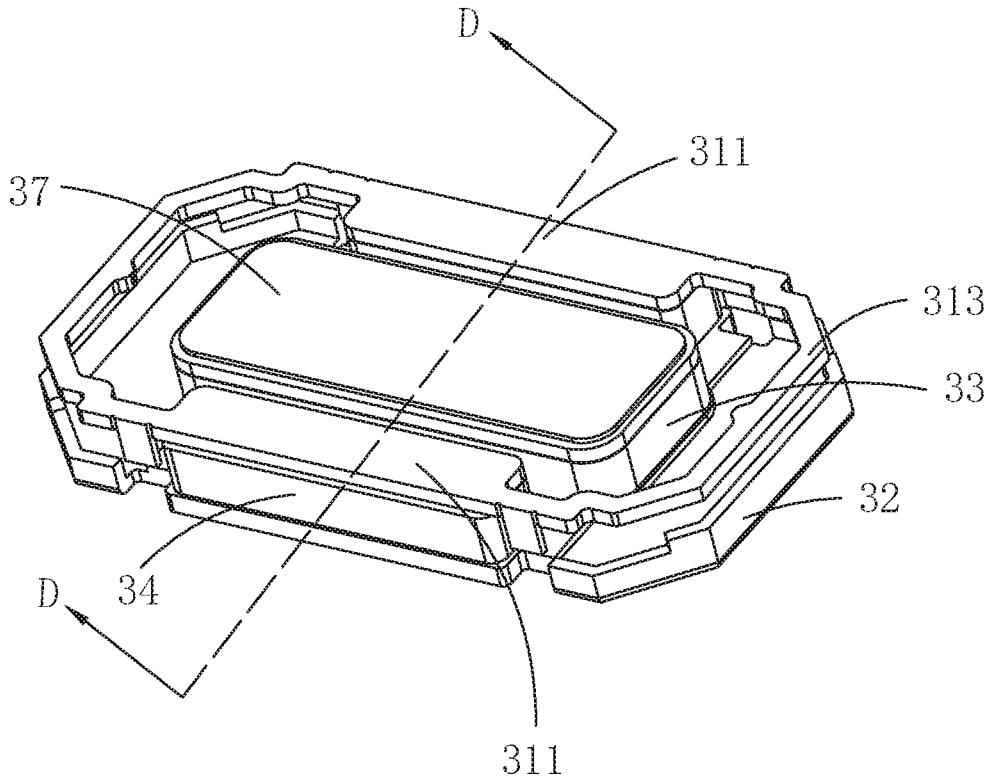
FIG. 7 is a three-dimensional perspective diagram of the magnetic circuit system of the speaker showing in FIG. 1.
Figure 8:
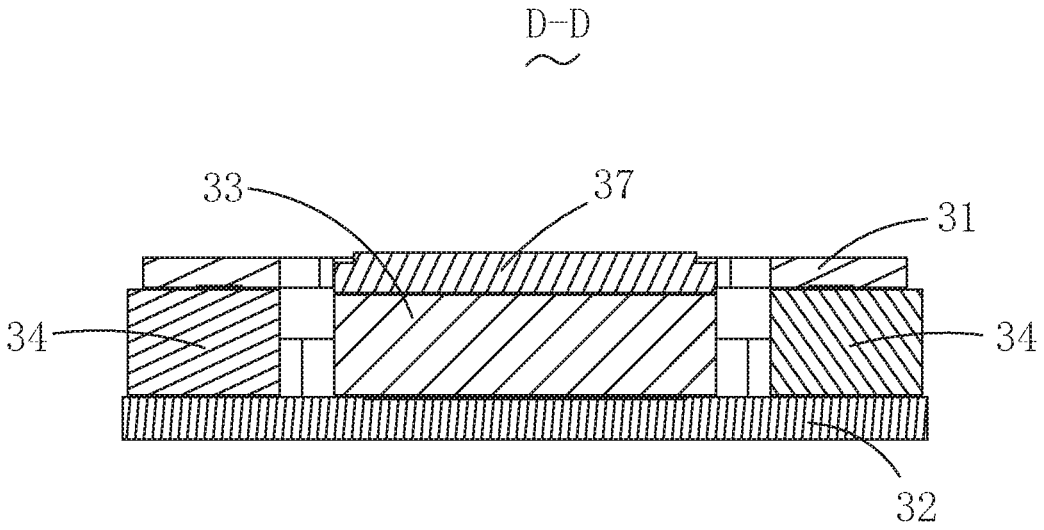
FIG. 8 is a cross-sectional diagram along the D-D line showing in FIG. 7.

Refer to FIG. 5, another speaker provided in this embodiment has the same features as Embodiment 2 except that the recessed depth H of the adhesive groove 312 is between 0.01 and 0.06 mm as shown in FIG. 5.

In the speaker of this embodiment, the recess depth H of the adhesive groove for accommodating the glue is preferably between 0.01 and 0.06 mm, and when the recess depth H of the adhesive groove is too large, the thickness of the adhesive body is larger, and the thick adhesive body is easy to break in the drop test; when the recessed depth H of the adhesive groove is too small, the contact area between the glue and the upper magnetic conductivity splint is insufficient to greatly improve the bonding force between the upper magnetic conductivity splint and the sub magnetic. The optimal anti-drop performance of the speaker can be achieved only when the depth of the depression is appropriate.

Embodiment 4

Another speaker provided in this embodiment has the same features as Embodiment 3 except that the recessed depth H of the adhesive groove 312 is 0.02 mm.

In the speaker of the embodiment, the recess depth H of the adhesive groove for accommodating the glue is preferably 0.02 mm, the contact area between the glue and the first clamping plate is optimal, and the first clamping plate and the sub magnetic can be effectively improved. The bonding force of the sub magnetic improves the problem that the first clamping plate and the sub magnetic have small bonding force and the separation failure in the drop experiment.

Embodiment 5

The speaker provided in this embodiment has the same features as the embodiment 4 except that the magnetic circuit system 3 further includes a second clamping plate 37, and the second clamping plate 37 is disposed on the main magnetic 33 and is connected to the main magnetic 33. The projection of the second clamping plate 37 completely coincides with the projection of the main magnetic 33 in the plane of the yoke 32 located.

In the speaker of this embodiment, the magnetic circuit system further includes a second clamping plate disposed on the main magnetic, and the setting can effectively improve the magnetic permeability of the magnetic circuit system.

The speaker of the present invention comprises a magnetic circuit system comprising a first clamping plate, a yoke, a main magnetic and a sub magnetic disposed in the yoke. Wherein the bonding portion of the first clamping plate bonded to the sub magnetic is provided with an adhesive groove recessed from the bonding portion away from the sub magnetic. When the first clamping plate is bonded to the sub magnetic, the glue is sandwiched between the first clamping plate and the sub magnetic, and the glue is filled in the adhesive groove, and the setting of the adhesive groove increases the contact area of the glue with the first clamping plate and is convenient. The amount of glue is increased and the glue does not overflow the glue surface, thereby increasing the bonding force between the first plate and the sub magnetic, and improving the problem that the first plate and the sub magnetic have a small bonding force and the separation failure in the drop test.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a frame;

a vibration system, which comprises a diaphragm and voice coil assembly driving the diaphragm to vibrate for generating sound, the diaphragm is located above the frame, the voice coil assembly is connected to the diaphragm and housed in the frame; and a magnetic circuit system, which comprises a first clamping plate housed in the frame, a yoke, a main magnetic and a sub magnetic disposed in the yoke, the sub magnetic is located on both sides of the main magnetic, and the sub magnetic and the main magnetic are spaced apart from each other to form a magnetic gap, wherein the first clamping plate is disposed on the sub magnetic and connected to the sub magnetic, the first clamping plate comprises a bonding portion connected to the sub magnetic, and the bonding portion is provided with an adhesive groove, the adhesive groove is recessed in a direction from a plane connecting the bonding portion and the sub magnetic toward away from the sub magnetic, and the magnetic circuit system further comprises an adhesive body which is sandwiched between the bonding portion and the sub magnetic.

2. The speaker as described in claim 1, wherein the first clamping plate further comprises a splint frame which is fixed to the frame, and the bonding portion extends in the direction from the splint frame toward the main magnetic.

3. The speaker as described in claim 2, wherein in the plane of the yoke is located, the projection of the bonding portion is completely covered by the projection of the sub magnetic.

4. The speaker as described in claim 3, wherein the first clamping plate is a central-symmetric structure.

5. The speaker as described in claim 4, wherein the adhesive body is glue.

6. The speaker as described in claim 5, wherein the recessed depth of the adhesive groove is between 0.01 mm and 0.06 mm.

7. The speaker as described in claim 6, wherein the recess depth H of the adhesive groove is 0.02 mm.

8. The speaker as described in claim 6, wherein the magnetic circuit system further includes a second clamping plate, the second clamping plate is disposed on the main magnetic and connected to the main magnetic.

9. The speaker as described in claim 8, wherein the projection of the second clamping plate completely coincides with the projection of the main magnet in the plane of the yoke located.

* * * * *